United States Patent [19]

Scheurer et al.

[11] Patent Number: 4,731,891

[45] Date of Patent: Mar. 22, 1988

[54] APPARATUS AND METHOD FOR MANUFACTURING A WATERPROOF PILLOW

[75] Inventors: Robert S. Scheurer; Stephen M. Scheurer, both of Wichita Falls, Tex.

[73] Assignee: Texas Recreation Corporation, Wichita Falls, Tex.

[21] Appl. No.: 749,894

[22] Filed: Jun. 28, 1985

[51] Int. Cl.[4] ..... A47C 20/02; A47K 3/022

[52] U.S. Cl. ..... 5/434; 4/575; 5/442

[58] Field of Search ..... 5/434, 473, 436, 440, 5/442; 441/129; 114/219; 4/575, 519, 517, 522

[56] References Cited

U.S. PATENT DOCUMENTS

| | | | |
|---|---|---|---|
| 1,740,791 | 12/1929 | Stern | 4/575 |
| 1,898,272 | 2/1933 | Stern | 4/575 |
| 1,953,798 | 4/1934 | Grandcourt | 4/575 |
| 2,167,178 | 7/1939 | Kohlstadt | 4/575 |
| 3,064,279 | 11/1962 | Finkle | 5/434 |
| 3,078,474 | 2/1963 | Chaitlen | 4/575 |
| 3,138,248 | 6/1964 | Abbott | 5/442 X |
| 3,319,272 | 5/1967 | Eller | 5/436 |
| 3,388,408 | 6/1968 | Blaney | 5/436 |
| 3,860,976 | 1/1975 | Suyama | 4/575 |
| 4,006,503 | 2/1977 | Wood | 5/473 X |
| 4,081,870 | 4/1978 | Iannucci | 5/434 |
| 4,147,825 | 4/1979 | Talalay | 5/434 |
| 4,383,713 | 5/1983 | Roston | 5/434 X |

FOREIGN PATENT DOCUMENTS

| | | | |
|---|---|---|---|
| 137073 | 4/1985 | European Pat. Off. | 5/434 |
| 882474 | 7/1953 | Fed. Rep. of Germany | 5/434 |
| 2002765 | 10/1970 | Fed. Rep. of Germany | 5/434 |
| 999217 | 7/1965 | United Kingdom | 5/434 |
| 1124473 | 8/1968 | United Kingdom | 5/434 |
| 1273259 | 5/1972 | United Kingdom . | |

*Primary Examiner*—J. Karl Bell

*Attorney, Agent, or Firm*—Dennis T. Griggs

[57] ABSTRACT

A waterproof pillow has body made of closed cell foam material and an open cell foam insert disposed with the airtight chamber formed by the body. After assembly, the pillows may be coated with a plastic material.

The combination of closed cell foam, an airtight chamber, and open cell foam creates a unique cushioning effect.

3 Claims, 5 Drawing Figures

APPARATUS AND METHOD FOR MANUFACTURING A WATERPROOF PILLOW

BACKGROUND OF THE INVENTION

This invention relates generally to comfort devices and, more particularly, relates to foam pillows that are completely waterproof.

While there are many different varieties of pillows available in the market today, none is suitable for use in wet environments such as in hot tubs, saunas and whirlpools.

The most common type of cushion is one that is filled with open cell foam material which is surrounded or encased by a woven fabric. However, water easily penetrates the woven fabric and becomes absorbed in the open cell foam material.

Inflatable cushions are known, but none have been commercially manufactured in sizes and shapes suitable as head pillows used in wet environments. Inflatable cushions do not make adequate pillows because they tend to be hard when inflated and prone to leakage.

For obvious reasons, open cell foam cushions could not be used, for instance, in a hot tub since the open cells would absorb water like a sponge.

Closed cell foam material, while being waterproof to a certain extent, has not been found to be adequate for forming cushions, since the material comes in sheet form and is generally harder than open cell foam. Also, the outer surfaces of closed cell foam material do not immediately shed water, and will retain a certain amount of surface water which could be discomforting if used in a wet environment.

No pillows, prior to now, have been devised specifically for use in wet environments. Also, none have been provided with self-attaching means for placement in desired locations.

SUMMARY OF THE INVENTION

The present invention overcomes many of the problems associated with the above-described prior art by providing a pillow that takes advantage of the better qualities of closed cell foam materials, open cell foam materials, and air cushioning.

In one embodiment of the invention, a body is formed by bonding together pieces of closed cell foam material. A lower sheet of the material is rectangular and has bell-shaped side pieces extending vertically upwardly at right angles to the lower sheet. The side pieces are also formed from sheets of closed cell foam material and have flat bases and parabolic upper edges that converge into opposite ends of the base. The side pieces are bonded along width-wise edges of the lower sheet. An upper sheet, being slightly wider than the lower sheet, is bonded at its length-wise edges to the length-wise edges of the lower sheet, and at its width-wise edges to the upper parabolic edge of the bell-shaped side pieces. After bonding, the various sheets and pieces form a body having a planar lower surface and a convex upper surface, and planar side surfaces at right angles to the upper and lower surfaces. Since the closed cell foam material is impenetrable to air, the interior chamber created within the body is airtight, and thereby provides an air cushion in the event that external pressure is applied to the outer surface of the body. Since the air within the interior chamber is at atmospheric air pressure, the cushion, without further development, would be extremely soft.

The present invention contemplates, prior to bonding all of the closed cell foam pieces, inserting an open cell foam core member or insert, which in itself provides a cushioning effect, and also serves to strengthen the airtight chamber by preventing complete flattening of the pillow.

Also, the present invention contemplates coating the closed cell foam body with vinyl plastic to provide a surface that instantly repels water. Attachment means may also be provided so that the cushion can be fixed in any position desired by the user.

To illustrate, it is customary to spend an extended period of time in a hot tub in order to take full advantage of the swirling water. Sitting in a hot tub can become tiring. To alleviate this fatigue, a user can take the applicants' invention, attach it to the edge of the hot tub, and lean back so that the user's head, instead of resting on the edge of the hot tub, rests on the pillow. Since hot tubs produce a great deal of steam and since water is commonly splashed about, a hot tub pillow would have to be totally waterproof. Also, any attachment means would have to be able to adhere to wet surfaces.

The present invention contemplates using suction cups which actually adhere better to a wet surface as means for attaching the pillow in desired positions. However, other means may be employed.

The object of the present invention, therefore, is to provide a portable, waterproof pillow that can be used in wet environments.

Another object of the invention is to provide a cushion that has a high degree of softness, and does not require inflating.

Another object of the invention is to provide an inexpensive cushion that is easily manufactured.

Another object of the invention is to provide a cushion that uses the combined cushioning effects of closed cell foam material, open cell foam material, and air.

Another object of the invention is to provide a pillow that has a convex outer surface which contacts the head of a user.

Another object is to provide a waterproof pillow comprising a hollow body made of closed cell foam material and having an airtight interior chamber, and an insert made of open cell foam material disposed within the airtight chamber.

These and other and further objects and features of the invention are apparent in the disclosure which includes the above and below specification and claims and drawings.

DETAILED DESCRIPTION OF THE DRAWINGS

In all drawings, the pillow is generally indicated by the number 1.

Figure 1:
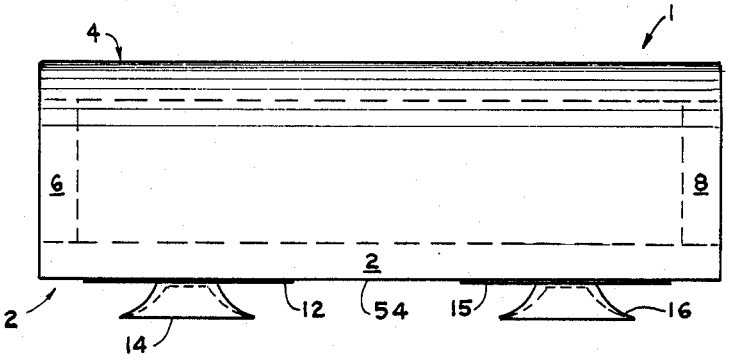
FIG. 1 is a side plan view of a cushion embodying features of the present invention.

Referring to FIG. 1, an embodiment of the present invention is shown from a side view with attachment means 14 and 16 extending downwardly from a flat bottom surface 54. The attachment means 14 and 16 are preferably adhesively bonded by applying adhesive to the upper surface of circular patches 12 and 15. The attached means can be disposed on any outer surface. However, it may be desirable to leave off the attachment means altogether.

Figure 5:
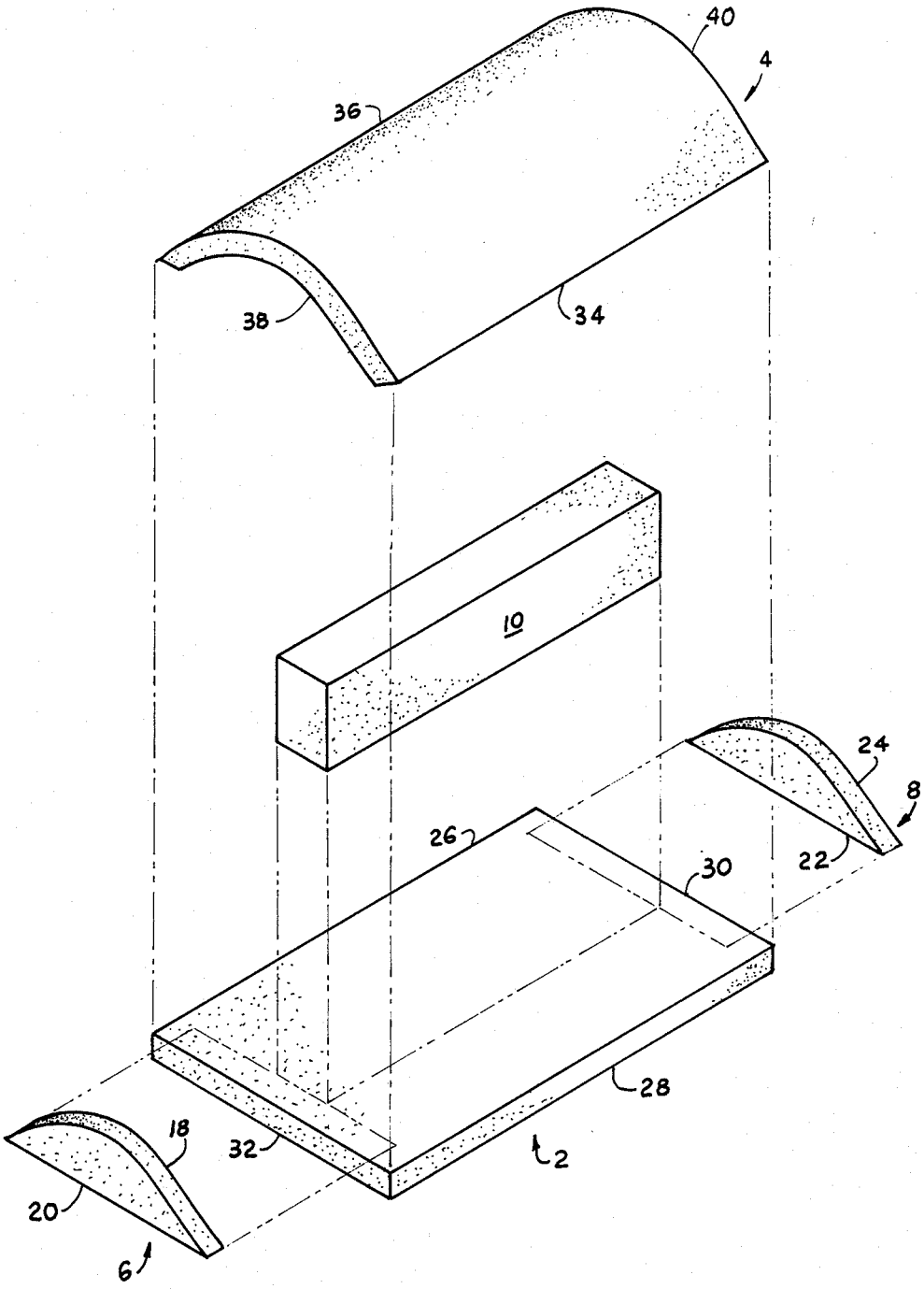
FIG. 5 is an exploded view of the apparatus of FIG. 1.

For a better understanding of the components and construction of the embodiment of FIG. 1, reference is now made to FIG. 5.

In FIG. 5 the body of the pillow is shown disassembled.

A sheet 2 of closed cell foam material has length-wise edges 26 and 28 and width-wise edges 30 and 32. Bell-shaped side members 6 and 8 are bonded to the width-wise edges 30, 32 of the sheet 2 along their bases 20 and 22 so that the side members extend vertically upwardly at right angles to the sheet 2 which acts as a horizontal base.

A second sheet 4 of closed cell foam material completes the structure of the body. However, prior to putting the sheet 4 in place, an insert 10 is placed on the upper surface 42 of the sheet 2 between the two side members 6 and 8. The length of the insert 10 is approximately equal to the distance between the side members.

When the insert 10 is in place, length-wise edges 34 and 36 of sheet 4 are bonded to the length-wise edges 28 and 26, respectively, of the lower sheet 2, and the width-wise edges 38, 40 are bonded to the parabolic surfaces 18 and 24, respectively, of the side members 6 and 8. In all cases, the pieces of the body are aligned so that the edges are flush.

After completing the above-described structure, the body is coated with vinyl plastic to impart total waterproofing. After coating with vinyl plastic, the attachment means 14 and 16 can be applied to lower surface 54, as shown in FIG. 1, or to any other surface.

Figure 2:
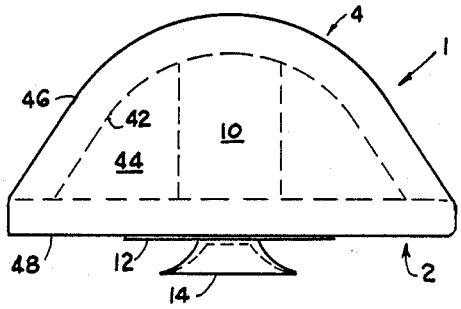
FIG. 2 is a side plan view of the apparatus shown in FIG. 1.

With reference to FIG. 2, the assembled cushion is shown as having a convex-shaped upper surface 46 and a planar lower surface 48. The insert 10 is shown by broken lines to be centrally located within an airtight chamber 44. It is preferable that the insert 10 does not extend to the apex of the cavity 44 so that the inner surface 42 of sheet 4 is completely surrounded by the air within the chamber 44, which is preferably at atmospheric pressure.

When external pressure is applied to the convex surface 46, as when a head of a user is rested upon the surface, the sheet 4 initially flattens towards the lower sheet 2, but the collapse is resisted by the air within the chamber 44. Since the closed cell foam material is soft, and since the airtight chamber 44 provides resistance to total flattening, a dual cushioning effect is created by the closed cell foam and the air pressure within the chamber 44. Additional cushioning is rendered by the open cell foam insert 10 when the sheet 4 is compressed to the point where the inner surface 42 contacts the insert 10.

Figure 3:
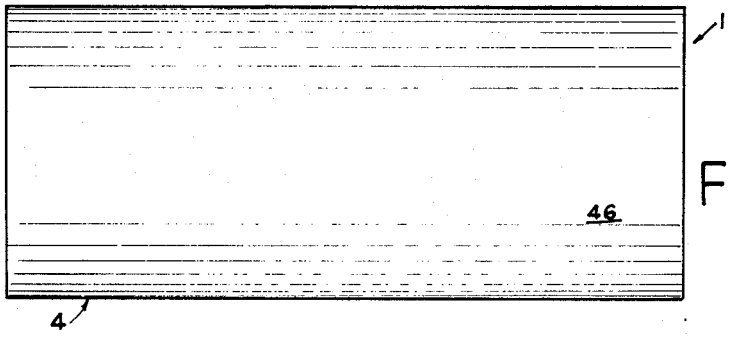
FIG. 3 shows a top plan view of the apparatus of FIG. 1.

FIG. 3 shows a top view of the assembled pillow with the outer surface 46 which, in cross section, appears convex.

Figure 4:
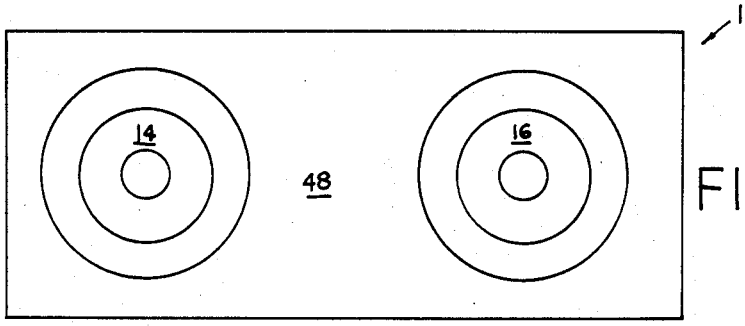
FIG. 4 is a bottom plan view of the apparatus of FIG. 1.

FIG. 4 shows a bottom view of the above-described embodiment, showing the lower surface 48 of the sheet 2 and the attachment means 14 and 16 which are preferably suction cups having flared bodies.

The overall shape of the embodiment described above is somewhat semi-cylindrical. However, it should be understood that the primary focus of the invention is on providing an airtight chamber within a body made of closed cell foam material, the airtight chamber being provided with an open cell foam insert.

The pillow can have other shapes, and other attachment means can be used, such as clips, straps, or cords. It would also be possible to provide VELCRO attachment means.

It should be understood that one of the features of the present invention is that the body, at all times, remains relatively small so that the device can be easily transported, for instance within a gym bag.

The embodiment described above is preferably approximately six inches by nine inches along the planar lower surface 48, and reaches a maximum height of approximately three inches. The outer surface 46, as shown in FIG. 2, converges at the ends thereof with the length-wise edges 26, 28 of the lower sheet 2.

While the invention has been described with reference to a specific embodiment, the exact nature and scope of the invention is defined in the following claims:

What I claim is:

1. A waterproof pillow for use in aqueous environments comprising, in combination:

a hollow pillow body constructed of closed cell foam material and enclosing an airtight interior chamber, said pillow body having a base sheet of closed cell foam material, first and second bell-shaped side members of closed cell foam material extending along opposite sides of the base sheet, the two side members each having a convex contour along a curved upper surface, the lower surface of each side member being bonded to the base sheet, and a covering sheet of closed cell foam material being bonded to the convex curved surfaces of the side members, and being bonded onto opposite edge portions of the base sheet to define a body having a planar base surface, a convex upper surface, and planar side surfaces extending transversely to the upper and lower surfaces; and an insert block of open cell foam material disposed within the airtight chamber intermediate said base sheet and said covering sheet, said insert block being spaced from said curved covering sheet, thereby defining first and second air pockets on opposite sides of said insert block;

whereby external pressure exerted on the pillow body is absorbed by compression of air contained within the airtight interior chamber acting in cooperation with compression of said insert block.

2. A waterproof pillow as defined in claim 1, wherein the external surface of said pillow body is sealed by a coating of water resistant polymer material.

3. A waterproof pillow as defined in claim 1, including:

first and second suction cups bonded to said base sheet of said pillow body, each suction cup having an attachment end connected to said base sheet and having a resilient cup for forming a suction attachment to a surface, each suction cup being stabilized by a mounting patch having an area of engagement with the base sheet which is larger than the effective area of the suction cup.

* * * * *